US005297366A

United States Patent [19]

Huddleston

[11] Patent Number: 5,297,366

[45] Date of Patent: Mar. 29, 1994

[54] SELF AFFIXING SANDING AND BUFFING PADS/SYSTEM AND APPARATUS

[76] Inventor: Michael D. Huddleston, P.O. Box 1353, Citrus Heights, Calif. 95611

[21] Appl. No.: 37,323

[22] Filed: Mar. 26, 1993

[51] Int. Cl.[5] ..... B24D 17/00

[52] U.S. Cl. ..... 51/376; 51/391; 51/392; 51/393; 51/406

[58] Field of Search ..... 51/376-379, 51/389, 391-393, 209 R, 394, 406

[56] References Cited

U.S. PATENT DOCUMENTS 3,362,114 1/1968 Hurst ..... 51/376
3,667,169 6/1972 MacKay, Jr. ..... 51/379
4,263,755 4/1981 Globus ..... 51/406
5,007,128 4/1991 Englund ..... 51/394
5,201,149 4/1993 Eisenblatter ..... 51/376
5,201,785 4/1993 Nagano ..... 51/376

*Primary Examiner*—Jack Lavinder

[57] ABSTRACT

An electric drill is used with a specially designed arbor to attach a drill pad to the drill. The drill pad is removeably affixed to a sanding disc or a buffing disc by hook and loop fasteners. The attached discs are firmly affixed to the drill pad for use while sanding or buffing a surface. The discs are easily pulled from the drill pad and a replacement is easily attached without needing to use tools.

1 Claim, 3 Drawing Sheets

SELF AFFIXING SANDING AND BUFFING PADS/SYSTEM AND APPARATUS

BACKGROUND OF THE INVENTION

1. Field of the Invention

This invention relates to sanding discs and buffing discs attachable to a drill pad for use with an electric drill. The present invention is particularly directed towards self-attaching discs affixed on a top surface with loops that adhere to hooks on the under surface of a drill pad. This hook and loop attachment adequately retains a spinning sandpaper or buffer disc during use and allows the discs to be easily detached and replaced.

2. Description of the Prior Art

The usual method of attaching a sanding disc to a drill pad is to adhere the sand paper to the bottom surface of a sanding disc by gluing and attaching the prepared sanding disc to the drill by a shank or by purchasing specially prepared sanding discs and attaching them by a shank to the drill chuck. For buffing, the buffer pad is usually fitted over the drill pad. Attaching and removing sanding discs to and from the drill pad requires time and tools to accomplish the task. When slip-over buffing pads are used, there is always the problem of the pad becoming loose or twisting around on the drill pad. Even if the buffing pad used is a fixed disc pad, tools and time are required for attaching it to the drill jaw.

SUMMARY OF THE INVENTION

Therefore, in practicing my invention, I provide a special arbor for an electric drill that fits through a drill pad with the drill pad being attachable to a variety of sanding discs or buffing discs by a hook and loop fasteners. Although it is immaterial on which surface the hook side or the loop side is affixed, for the purpose of this invention, the hook side is on the bottom surface of the drill pad. The loop side is affixed to the top surfaces of the sanding disc and the buffing disc. The hook and loop fasteners adequately maintain the disc surface and the pad surface firmly attached while pressure is applied to the disc surface during use. For replacement, the hook and loop attached discs come apart easily with a pull.

A principal object of the present invention, then, is to provide mechanics for easy attachment and detachment of a sanding disc and a buffing disc to a drill pad by hook-and loop fasteners.

Another object of the invention is to provide an easy method for attaching a sanding disc and a buffing disc to a drill pad without the need to use tools.

A further object of my invention is to provide for the attachment of sanding discs and buffing discs to a drill with no solvents or adhesives being required to accomplish the attachment.

A still further object is to provide in this invention a method of maintaining a sanding disc attached to a drill to effect maximum efficiency while sanding hardwoods.

Another object of the immediate invention is to provide maximum efficiency for sanding in a device that will not fold under pressure and adding longer life to the sanding disc.

A further object of this invention is to provide an exchangeable sanding and buffing device that can be used virtually anywhere.

Other object and the many advantages of the present invention will become clear from reading the specification and comparing numerically designated parts described relative to the same numbered parts illustrated in the drawings.

DESCRIPTION OF THE PREFERRED EMBODIMENT

Figure 1:
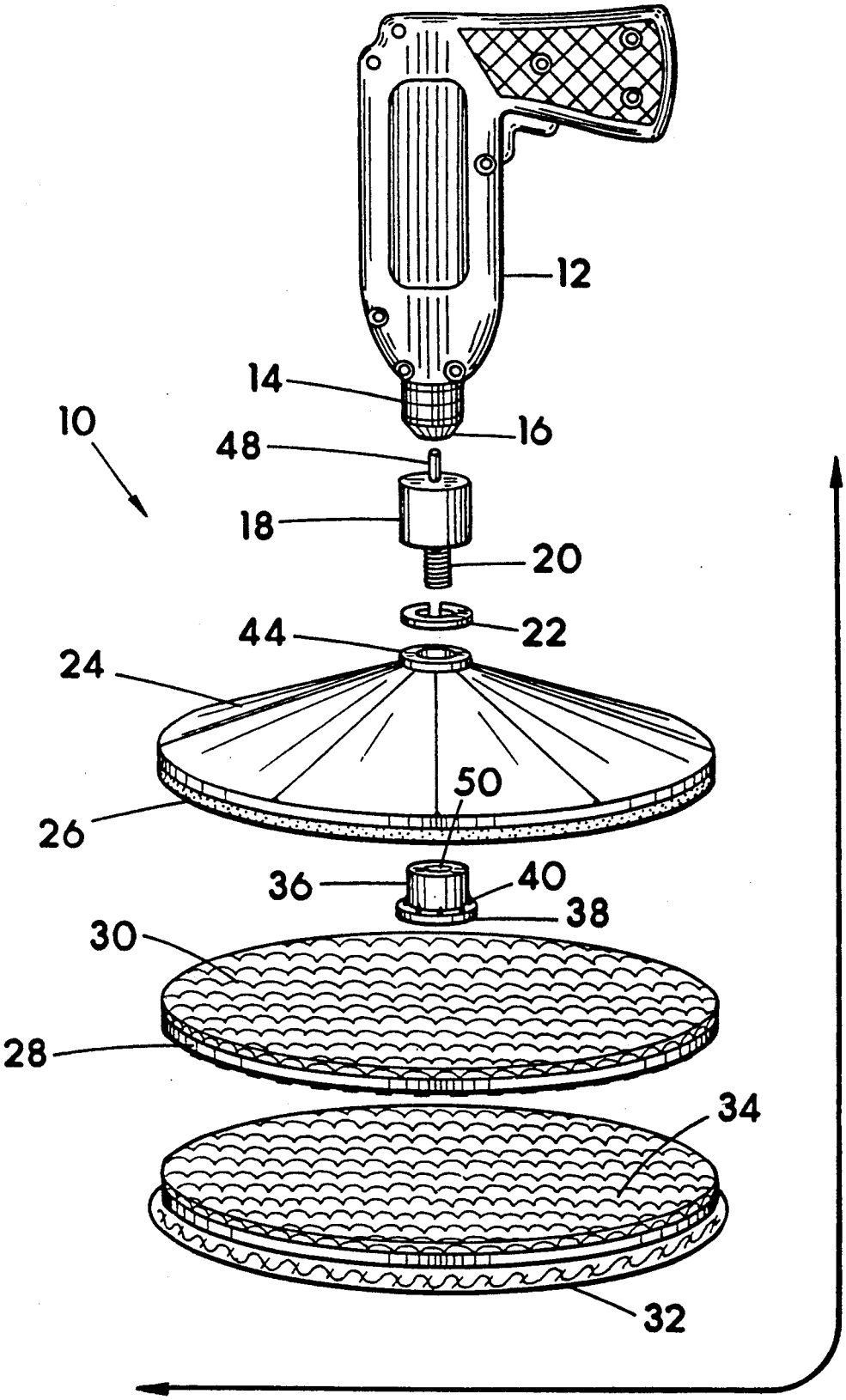
FIG. 1 shows the parts of the present invention positioned ready for assemblage below a type of hand drill typically used with sanding and buffing discs. The discs are enlarged relative to the drill to better illustrate the invention.
Figure 3:
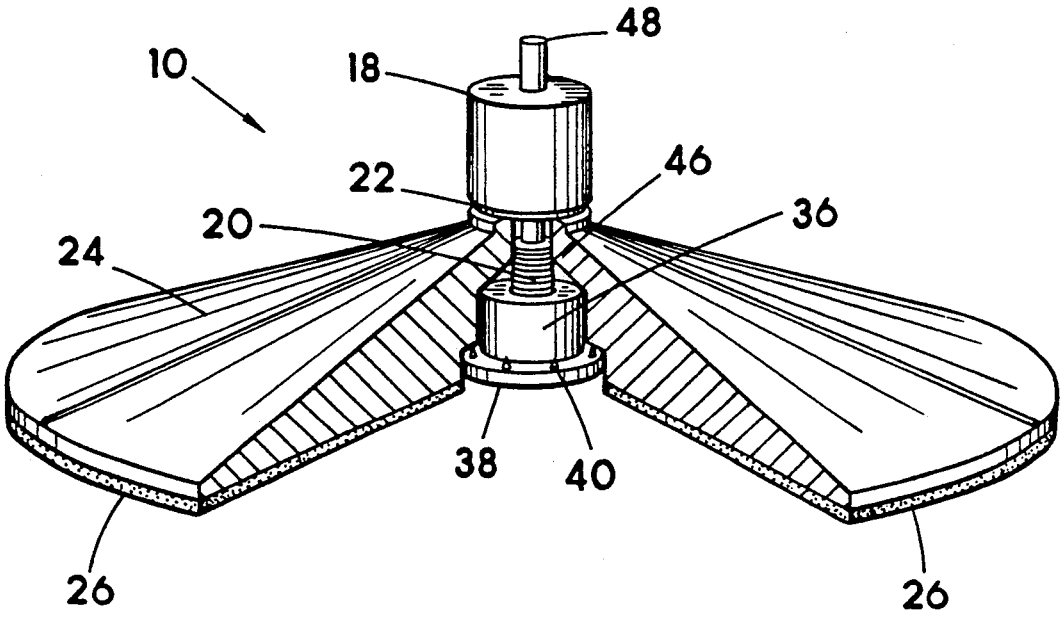
FIG. 3 shows the drill pad of FIG. 2 with the drill pad retainer installed in the drill pad shaft and the threaded bit of the arbor in the threaded female shaft of the drill pad retainer. Spaced lock teeth on the upper side of the retainer rim prevent the drill pad retainer from spinning free on the arbor shaft.

Referring now to the drawings at FIG. 1 where the invention is generally indicated by arrow in the drawings and referred to herein as invention 10. In the FIG. 1 illustration, invention 10 is positioned ready for attachment to electric hand drill 12 at jaws 16 in chuck 14 by the upper arbor jaw bit 48 of special arbor 18. Threaded bit 20 on the lower end of arbor 18 passes through lock washer 22 and eventually rests on the arbor receiver rim of shaped shaft 44 at the top of drill pad 24 (see assembled drill pad 24 in FIG. 3). The upper surface of drill pad 24 is cone shaped widening downward into a rounded flat lower surface with hook locks 26 covering the surface. For retaining drill pad 24 to arbor 18, a drill pad retainer 36 is provided. Drill pad retainer 36 has an external rim 38 collaring the lower end. On the upper side of rim 38 spaced teeth 40 can be seen pointing upwards. Teeth 40 bite into the widened lower section of shaped shaft 44. Threaded bit 20 tightens down into threaded female shaft 50 centered in arbor 18. Below drill pad 24 the upper surface of sanding disc 28 can be seen covered with loop locks 30. When the upper surface of sanding disc 28 is pushed up against the lower surface of drill pad 24, hooks 26 and loops 30 interlock and sanding disc 28 becomes firmly attached to the under side of drill pad 24. Drill 12 with sanding disc 28 attached is then ready for use (See FIG. 4). Buffer disc 32, the buffer being the lower surface, will also attach to drill pad 24 by lock loops 34 on the upper surface. When these surfaces contact each other a strong fastening occurs because of the hook and loop fasteners provided in hooks 26 and loops 30 of sanding disc 28 or loops 34 of buffing disc 32. It is immaterial whether hooks 26 are on the bottom of drill pad 24 or on the top surface of sanding disc 28 so long as one surface is hook covered and the opposite surface is loop covered. Hook and loop fasteners are in common use and are not necessarily present here as part of this invention. The use of hook and loop fastening is unique to this invention as a new use for a known product to provide easy attachment and detachment of sanding discs (28) and buffing discs (32) to a drill pad (24).

Figure 2:
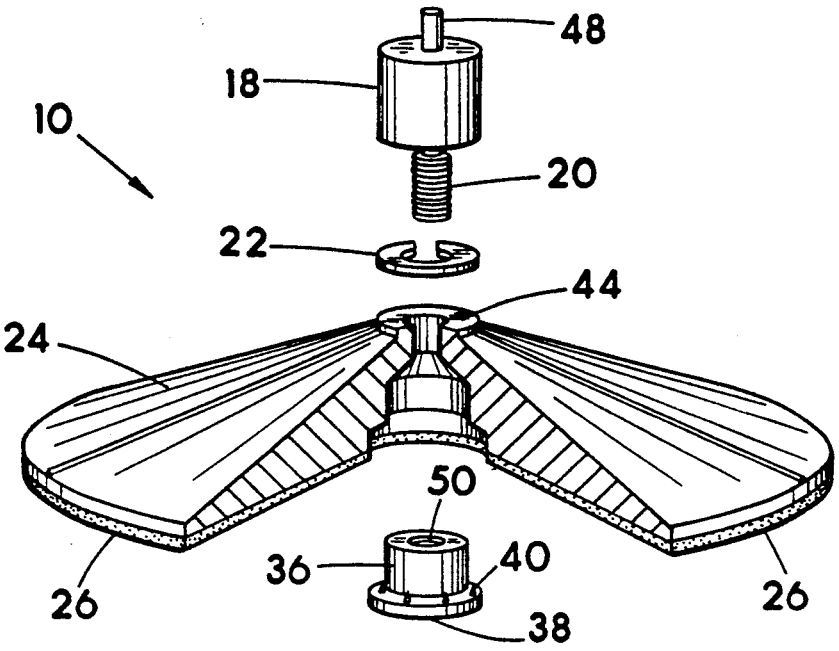
FIG. 2 shows the drill pad of the immediate invention sectioned along a side to illustrate the specially shaped pad retainer shaft designed to fit the shape of the drill pad retainer.

In FIG. 2, a cutaway view of drill pad 24 shows shaped pad retainer shaft 44. Drill pad retainer 36 is shown ready for placement up inside into shaped pad retainer shaft 44. Threaded bit 20 of arbor 18 will insert into shaft 44 through lock washer 22. Lock washer 22 will hold threaded bit 20 tightened down into threaded female shaft 50 of drill pad retainer 36. Teeth 40 will bite into the inner surface of shaft 44 and prevent drill pad 24 from turning freely when the devices are assembled. The assembled units of invention 10 can be seen in FIG. 3.

Figure 4:
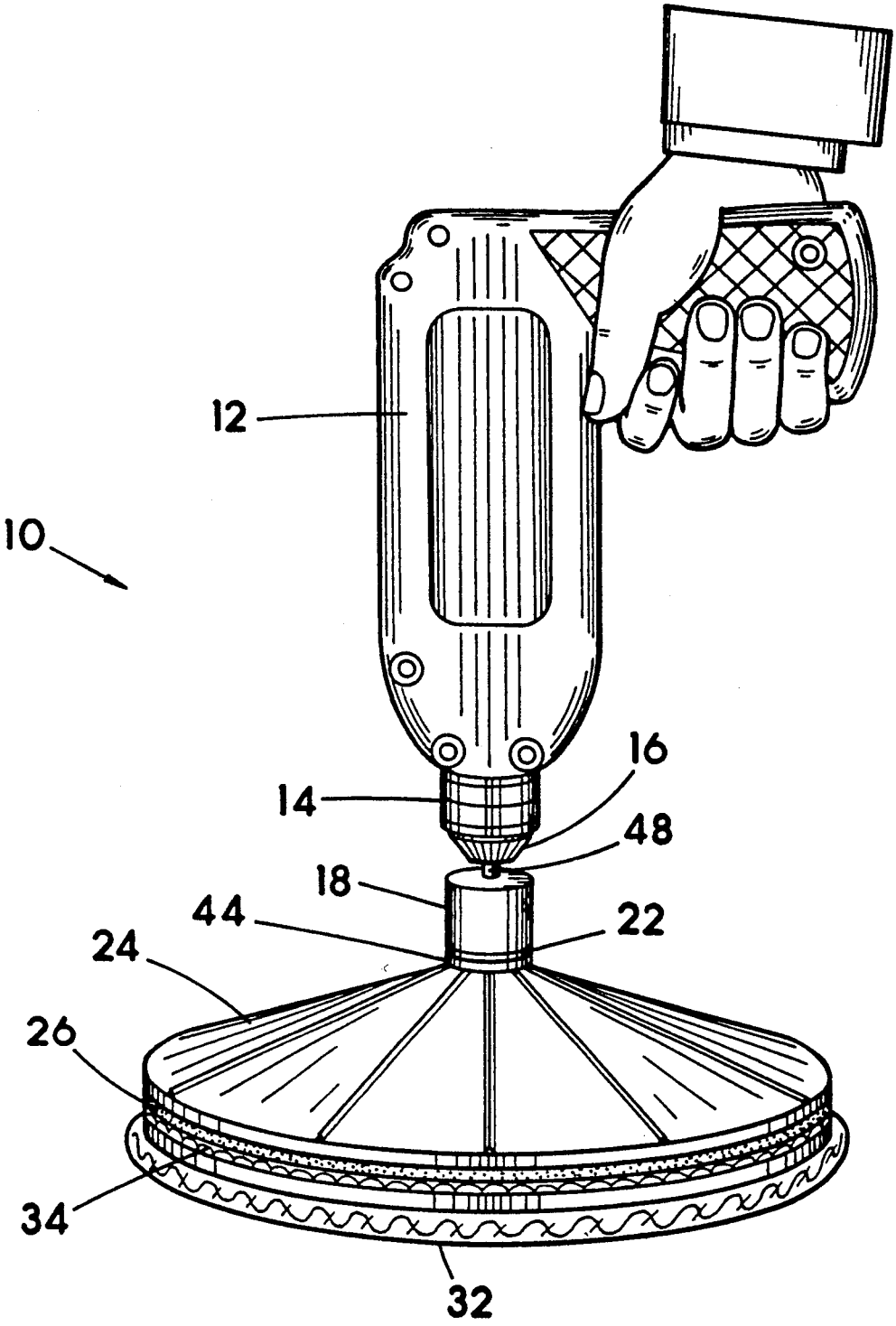
FIG. 4 shows the invention in use with a buffing disc affixed by hook and loop attachment to the drill pad.

FIG. 4 illustrates drill 12 with buffer disc 32 attached to drill pad 24 by loop locks 34 interlocked with hook locks 26. Invention 10 is illustrated ready for use. Although buffer disc 32 can easily be pulled lose from drill pad 24 by a straight pull, it requires considerable force to pull disc 32 and pad 24 apart crosswise or at a very flat angle. Our experiments have shown that spinning discs attached in this manner hold securely and do no tend to separate even when subjected to very hard usage. It is noted that the present invention 10 makes attachment and detachment of any discs including those illustrated as 28 and 32 easy.

Although I have described embodiments of my invention with considerable detail in the foregoing specification and have illustrated them extensively in the drawings, it is to be understood that I may practice variations in the invention which do not exceed the scope of the appended claims. Also, any variations of my invention practiced by others which fall within the scope of my claims, I shall consider to be my invention.

What is claimed is:

1. A drill pad assembly for releasably retaining a polishing disc and having an attachment device for attaching the drill pad to a hand drill comprising;

a conical shaped drill pad having an arbor receiver rim located on the top of the drill pad, a drill retainer receiving bore located on the bottom of the drill pad opposite the arbor receiver rim, a through bore extending between the receiver rim and the retainer bore and a hook or loop interlock surface located on the bottom surface of the drill pad for releasably retaining a polishing disc having a hook or loop surface;

wherein the attachment device comprises a special arbor having an upper arbor shaft for attaching to a drill chuck, a middle section extending from the upper arbor shaft having a larger diameter than the upper arbor shaft and being in contact with the arbor receiver rim, a threaded shaft extending from the middle section into the through bore, and a drill pad retainer extending in the receiving bore and attaching to the threaded shaft;

wherein the drill pad retainer comprises an external rim having spaced teeth located thereon extending in a direction toward the receiver rim when the drill pad retainer is secured to the threaded shaft so that the teeth engage the drill pad to prevent the pad from rotating with respect to the attachment device.

* * * * *